US008717245B1

(12) United States Patent
Krivokapic et al.

(10) Patent No.: US 8,717,245 B1
(45) Date of Patent: May 6, 2014

(54) PLANAR MULTILAYER HIGH-GAIN ULTRA-WIDEBAND ANTENNA

(75) Inventors: Ivan Krivokapic, San Diego, CA (US); Alexandr Yampolsky, San Diego, CA (US)

(73) Assignee: Olympus Corporation, Tokyo (JP)

( * ) Notice: Subject to any disclaimer, the term of this patent is extended or adjusted under 35 U.S.C. 154(b) by 883 days.

(21) Appl. No.: 12/725,383

(22) Filed: Mar. 16, 2010

(51) Int. Cl.
*H01Q 9/28* (2006.01)
*H01Q 9/16* (2006.01)

(52) U.S. Cl.
USPC ..... 343/795; 343/802; 343/807

(58) Field of Classification Search
USPC ..... 343/802, 793, 795, 700 MS, 807, 818, 343/819
See application file for complete search history.

(56) References Cited

U.S. PATENT DOCUMENTS

| | | | | |
|---|---|---|---|---|
| 2,860,339 | A * | 11/1958 | Kandoian | 343/795 |
| 4,359,741 | A | 11/1982 | Cassel | |
| 4,700,194 | A * | 10/1987 | Ogawa et al. | 343/700 MS |
| 4,843,403 | A | 6/1989 | Lalezari et al. | |
| 4,978,919 | A | 12/1990 | Hinks | |
| 5,477,233 | A | 12/1995 | Hemming et al. | |
| 5,532,708 | A * | 7/1996 | Krenz et al. | 343/795 |
| 5,867,130 | A * | 2/1999 | Tay et al. | 343/795 |
| 5,987,033 | A | 11/1999 | Boer et al. | |
| 6,043,785 | A | 3/2000 | Marino | |
| 6,091,374 | A | 7/2000 | Barnes | |
| 6,292,152 | B1 * | 9/2001 | Cosenza et al. | 343/745 |
| 6,400,329 | B1 | 6/2002 | Barnes | |
| 6,407,708 | B1 | 6/2002 | Jasper, Jr. | |
| 6,452,462 | B2 | 9/2002 | Lo | |
| 6,518,931 | B1 | 2/2003 | Sievenpiper | |
| 6,556,169 | B1 * | 4/2003 | Fukuura et al. | 343/700 MS |
| 6,600,449 | B2 * | 7/2003 | Onaka et al. | 343/700 MS |
| 6,621,462 | B2 | 9/2003 | Barnes | |
| 6,710,744 | B2 | 3/2004 | Morris | |
| 6,720,926 | B2 * | 4/2004 | Killen et al. | 343/700 MS |
| 6,839,036 | B1 | 1/2005 | Apostolos | |
| 6,842,154 | B1 | 1/2005 | Apostolos | |
| 6,845,253 | B1 | 1/2005 | Schantz | |
| 6,853,194 | B2 | 2/2005 | Nelson | |
| 6,882,322 | B1 | 4/2005 | Apostolos | |
| 6,900,770 | B2 | 5/2005 | Apostolos | |
| 7,050,013 | B2 | 5/2006 | Kim et al. | |
| 7,119,748 | B2 * | 10/2006 | Autti | 343/702 |
| 7,123,207 | B2 * | 10/2006 | Yazdandoost et al. | 343/795 |
| 7,358,920 | B2 | 4/2008 | Apostolos et al. | |

(Continued)

OTHER PUBLICATIONS

Jani Ollikainen, Pertti Vainikainen, Design and Bandwidth Optimization of Dual-Resonant Patch Antennas, Mar. 2002, Report S 252, Helsinki University of Technology, Finland.

(Continued)

*Primary Examiner* — Michael C Wimer
*Assistant Examiner* — Hasan Islam
(74) *Attorney, Agent, or Firm* — Sheppard Mullin Richter & Hampton LLP

(57) ABSTRACT

A dipole antenna for wide-band communications. Some embodiments relate to a multilayer planar high-gain antenna for ultra-wideband communications having a broadband dipole structure, a tuning plate and a feed arranged roughly parallel to one another and separated from one another with dielectric materials. In one embodiment, the antenna includes four conductive layers, a reflector, which is preferably rectangular, a broadband bowtie preferably of bowtie shape, a feed structure and a parasitic element or tuning patch.

20 Claims, 15 Drawing Sheets

(56) References Cited

U.S. PATENT DOCUMENTS

| | | | | |
|---|---|---|---|---|
| 7,388,554 | B2 | 6/2008 | Askildsen | |
| 7,415,295 | B2 * | 8/2008 | Tran | 455/575.7 |
| 7,432,839 | B2 | 10/2008 | Christ | |
| 7,555,294 | B2 | 6/2009 | Qi et al. | |
| 7,570,063 | B2 | 8/2009 | Van Veen et al. | |
| 7,626,557 | B2 | 12/2009 | Eckwielen et al. | |
| 7,647,089 | B2 | 1/2010 | Bond et al. | |
| 2001/0043128 | A1 | 11/2001 | Lo | |
| 2002/0154064 | A1 | 10/2002 | Barnes | |
| 2003/0052684 | A1 | 3/2003 | Nelson et al. | |
| 2003/0088180 | A1 | 5/2003 | Van Veen et al. | |
| 2003/0122713 | A1 | 7/2003 | Morris | |
| 2005/0024281 | A1 | 2/2005 | Apostolos | |
| 2005/0024282 | A1 | 2/2005 | Apostolos | |
| 2005/0078043 | A1 | 4/2005 | Apostolos | |
| 2005/0176029 | A1 | 8/2005 | Heller et al. | |
| 2005/0200549 | A1 | 9/2005 | Thompson | |
| 2006/0055612 | A1 | 3/2006 | Kim et al. | |
| 2006/0058606 | A1 | 3/2006 | Davis et al. | |
| 2006/0152412 | A1 * | 7/2006 | Evans et al. | 343/700 MS |
| 2006/0181474 | A1 | 8/2006 | Apostolos et al. | |
| 2006/0183995 | A1 | 8/2006 | Bond et al. | |
| 2006/0241409 | A1 | 10/2006 | Winters et al. | |
| 2006/0256025 | A1 | 11/2006 | Askildsen | |
| 2006/0264732 | A1 | 11/2006 | Wu | |
| 2006/0267855 | A1 | 11/2006 | Askildsen | |
| 2007/0152881 | A1 | 7/2007 | Chan | |
| 2007/0207756 | A1 | 9/2007 | Qi et al. | |
| 2007/0229379 | A1 | 10/2007 | Eckwielen | |
| 2007/0262912 | A1 | 11/2007 | Eckwielen et al. | |
| 2008/0204291 | A1 | 8/2008 | Christ | |
| 2008/0204299 | A1 | 8/2008 | Christ | |
| 2008/0211726 | A1 | 9/2008 | Elsallal | |
| 2008/0309573 | A9 | 12/2008 | Eckwielen et al. | |
| 2008/0311871 | A1 | 12/2008 | Qi et al. | |
| 2009/0096676 | A1 | 4/2009 | Yan et al. | |
| 2009/0099862 | A1 | 4/2009 | Fireman et al. | |
| 2009/0102705 | A1 | 4/2009 | Obermeyer | |
| 2009/0273533 | A1 | 11/2009 | Wolf et al. | |
| 2010/0053002 | A1 * | 3/2010 | Wojack et al. | 343/702 |

OTHER PUBLICATIONS

Alireza Foroozesh and Lotfollah Shafai, Performance Enhancement of a Microstrip Patch Antenna Using High Impedance Surfaces and Different Ground Plane Sizes, Proceedings of ISAP 2007, Niigata, Japan.

Mohammad Tariqui Islam, Mohammed Nazmus Shakib, Norbahiah Misran. Tiaug Sew Sun, Broadband Microstrip Patch Antenna, European Journal of Scientific Research, ISSN I450-216X vol. 27 No. 2 (2009), pp. 174-180, EuroJournals Publishing, Inc. 2009.

* cited by examiner

| | |
|---|---|
| Frequency | = 6.5 |
| Main lobe magnitude | =7.7 dB |
| Main lobe direction | =180.0 deg |
| Angular width [3 dB] | =86.2 deg. |
| Side lobe level | -9.9 dB |

| | |
|---|---|
| Frequency | = 7 |
| Main lobe magnitude | =7.9 dB |
| Main lobe direction | =180.0 deg |
| Angular width [3 dB] | =83.1 deg. |
| Side lobe level | -12.9 dB |

| | |
|---|---|
| Frequency | = 7.5 |
| Main lobe magnitude | =7.7 dB |
| Main lobe direction | =180.0 deg |
| Angular width [3 dB] | =85.6 deg. |
| Side lobe level | -15.1 dB |

| | |
|---|---|
| Frequency | = 8 |
| Main lobe magnitude | =7.5 dB |
| Main lobe direction | =180.0 deg |
| Angular width [3 dB] | =90.3 deg. |
| Side lobe level | -16.0 dB |

| | |
|---|---|
| Frequency | = 8.5 |
| Main lobe magnitude | =7.9 dB |
| Main lobe direction | =180.0 deg |
| Angular width [3 dB] | =89.1 deg. |
| Side lobe level | -16.8 dB |

PLANAR MULTILAYER HIGH-GAIN ULTRA-WIDEBAND ANTENNA

TECHNICAL FIELD

The present invention relates generally to antennas, and more particularly, some embodiments relate to a planar multilayer high-gain antenna for ultra-wideband communications.

DESCRIPTION OF THE RELATED ART

With the many continued advancements in communications technology, more and more devices are being introduced in both the consumer and commercial sectors with advanced communications capabilities. Additionally, advances in processing power and low-power consumption technologies, as well as advances in data coding techniques have led to the proliferation of wired and wireless communications capabilities on a more widespread basis.

For example, communication networks, both wired and wireless, are now commonplace in many home and office environments. Such networks allow various heretofore independent devices to share data and other information to enhance productivity or simply to improve their convenience to the user. Examples of communication networks that are gaining widespread popularity include exemplary implementations of wireless networks such as the Bluetooth®, Wireless USB, and various IEEE standards-based networks such as 802.11 and 802.16 communications networks, to name a few.

Architects of these and other networks, and indeed communications channels in general, have long struggled with the challenge of improving the performance of wireless devices. One area in which designers have focused is on creating better performing high-gain planar antennas for use in wireless applications, such as wireless local area networks (LANs), wide area networks (WANs) and personal area networks (PANS).

The simplest microstrip antenna uses a half-wavelength-long conductive patch positioned roughly parallel to a ground plane and separated from the ground plane by a constant thickness dielectric. Ground planes larger than the conductive radiator tend to produce stable patterns and lower environmental sensitivity but at the cost of a larger package size. FIG. 1A is a diagram illustrating a simple example of a patch antenna. This example includes a patch radiator 9 separated from a ground plane 11 by a dielectric material 10 of thickness h. Upon application of a signal, electromagnetic waves propagate between the patch 9 and the ground plane 11. Fringing fields 8 around the edges of the patch 9 tend to make the effective length of the patch 9 longer than its actual length L. Accordingly, the patch it is typically trimmed by a few percent to achieve resonance at the desired center frequency $f_C$. The frequency of operation, or center frequency $f_c$ is a function of the length, L, and can be approximated by:

$$f_c = c/2L\sqrt{\epsilon_r}$$

where $\epsilon_r$ is the permittivity of the dielectric layer 10.

In operation, the current is maximum at the center of the half-wave patch 9, but it is zero at the open circuit end, and theoretically also zero at the feed end of the patch 9. This low current value at the feed contributes to a relatively high impedance of the patch. Because the patch antenna effectively presents an open-circuit transmission line, the voltage reflection coefficient at the end of the patch is −1. Accordingly, the voltage and current are out of phase and the voltage is at a maximum at the open-circuit end of the patch. At the feed end of the patch (a half-wavelength away), the voltage must be at minimum. As illustrated in FIG. 1A, the fringing fields travel in an additive direction, and therefore combine in phase to produce the antenna's radiation.

Decreasing the permittivity $\epsilon_r$ of the substrate will yield broader fringing fields that extend farther away from the patch, resulting in better radiation. This can be contrasted to a microstrip transmission line in which a high permittivity dielectric is used to confine the fields and reduce unwanted radiation.

FIG. 1B is a diagram illustrating a simple example of a patch and microstrip transmission line to feed the antenna. The width, W, of the antenna affects the input impedance. If a ½λ square patch is used, the input impedance would be undesirably high for most applications. However, to reduce the input impedance to 50Ω would require a width too large to be desirable for most applications. Accordingly, various feed mechanisms are used to adjust the input impedance of the antenna. In the example illustrated in FIG. 1B, an inset feed is used to feed the antenna closer to the center of the half-wave patch where the current is higher. Because the input impedance is given by $$Z = V/I,$$

feeding the antenna where the current I is higher, reduces the input impedance Z.

Because the current is sinusoidal, moving the feed a distance D from the edge of patch 9 increases the current by $$\cos(\pi D/L).$$

Other feed techniques can also be used, including quarter-wave transmission line feeds, aperture feeds, probe feeds, coupled feeds and so on.

Although desirable for their small size, high-gain planar microstrip antennas have presented a design challenge for wideband applications because microstrip antennas are inherently narrowband antennas. With numerous applications for high-bandwidth content requiring high data throughput such as, for example, video streaming, antenna bandwidth has become an increasingly important factor. This is especially the case with ultra-wideband (UWB) wireless transmission systems where a wideband antenna is needed to meet the bandwidth requirements of the system.

The impedance bandwidth of an antenna is the frequency range within which the antenna has a usable bandwidth relative to a given impedance, usually 50Ω. The useable bandwidth of a patch or strip antenna is typically limited to a few percent with respect to the center frequency. This narrow band characteristic can negatively impact the channel capacity in a wireless system. Accordingly, high data throughput requirements are usually obtained at the expense of range and with increased sensitivity to multipath.

In an ideal system, the maximum capacity for a band-limited additive white Gaussian noise (AWGN) channel is a function of the bandwidth and the signal-to-noise ratio. According to the Shannon-Hartley theorem, the channel capacity, C, or the theoretical upper bound of the information rate, that can be transmitted with an average signal power, S, over a channel with AWGN of N, is:

$$C = B\log_2(1+S/N)$$

Accordingly, the theoretical maximum data rate of the system can be improved by increasing the system bandwidth or increasing transmission power. However, increasing the transmission power typically has a negative impact on battery life and may create interference with other devices. With UWB systems, for example, information is transmitted over a relatively large bandwidth (for example, >500 MHZ) to allow for increased channel capacity. Therefore, for UWB systems and other wideband applications, antenna designers have sought to increase antenna bandwidth to accommodate wideband communications.

Conventional methods for increasing the bandwidth of antennas include techniques such as increasing the substrate thickness, using a low dielectric substrate, various impedance matching and feeding techniques, and using slot antenna geometry. Another technique for increasing the impedance bandwidth of resonant antennas is to add one or more resonators to the antenna structure to achieve dual- or multi-resonant characteristics. Another solution, increases impedance bandwidth with a relatively small size using shorting pins or shorting walls on unequal arms of a U-shaped patch, U-slot patch, or L-probe feed patch antennas. However, many of the available high-gain ultra-wideband solutions are based on tapered slot or horn antennas. Most reflector-backed broadband dipole antennas are designed to operate with a balanced feed and use balun transformers, which introduce additional losses and complicate the design.

BRIEF SUMMARY OF EMBODIMENTS OF THE INVENTION

According to various embodiments of the invention a multilayer planar high-gain antenna for ultra-wideband communications having a broadband dipole structure is provided. Embodiments include a tuning plate and a feed arranged roughly parallel to the dipole and separated from one another with dielectric materials. In one embodiment, the antenna includes four conductive layers, a reflector, which is preferably rectangular, a broadband dipole preferably of bowtie shape, a feed structure and a parasitic element or tuning patch.

According to an embodiment of the invention an antenna includes a bowtie dipole disposed on a first side of a substrate, the bowtie dipole comprising a pair of first and second opposed conductive elements, wherein each of the first and second opposed elements of the second dipole is defined by a triangular pattern; and a feed structure disposed on a second side of the substrate, the feed structure comprising a pair of third and fourth opposed conductive elements, wherein the length of the fourth element is longer than a length of each of the first and second opposed elements of the bowtie dipole, and wherein the feed structure is disposed on the substrate such that the third element of the feed structure overlaps with the first element of the bowtie dipole and the fourth element overlaps with both the first and second elements of the bowtie dipole; wherein the length of the fourth element is chosen so as to impedance match the first element of the bowtie dipole with a transmission line for feeding the antenna.

The antenna can further include a circular, roughly circular or otherwise shaped tuning element substantially parallel to and spaced from the bowtie dipole and the feed structure by a dielectric material. The tuning element can be positioned such that a center of the tuning element is aligned with a center of the bowtie dipole.

A reflector can be provided and is preferably substantially parallel to and spaced apart from the bowtie dipole with a dielectric material between the reflector and the bowtie dipole. In some embodiments, the reflector, bowtie dipole and feed structure are configured in a multilayer stack of conductive elements separated by dielectric material. Conducting elements of the antenna can include materials such as, for example, copper, gold, silver, conductive alloys, conductive polymers, and conductive carbon films. The substrate can be made using, for example, polytetrafluoroethylene, liquid crystal polymers, phenolics, phenolic cotton paper, cotton paper and epoxy, woven glass and epoxy, matte glass and polyester, woven glass and polyester. An example of polytetrafluoroethylene (PTFE) materials is the Rogers RO3000® family of ceramic-filled PTFE composite High Frequency Circuit Materials such as, for example, Rogers RO3003™.

In yet another embodiment, a multilayer antenna stack includes a first layer comprising a bowtie dipole comprising a pair of first and second opposed conductive elements, wherein each of the first and second opposed elements of the second dipole is defined by a triangular pattern; a second layer comprising a dielectric material adjacent the first layer; and a third layer adjacent the second layer and spaced apart from the first layer by the second layer, the third layer comprising a feed structure, the feed structure comprising a pair of third and fourth opposed conductive elements, wherein the length of the fourth element is longer than a length of each of the first and second opposed elements of the bowtie dipole, and wherein the feed structure is disposed on the second layer such that the third element of the feed structure overlaps with the first element of the bowtie dipole and the fourth element overlaps with both the first and second elements of the bowtie dipole; wherein the length of the fourth element is chosen so as to impedance match the first element of the bowtie dipole with a transmission line for feeding the antenna. In one embodiment, the stack can also include a fourth layer comprising a dielectric material adjacent the third layer and a fifth layer adjacent the fourth layer and spaced apart from the third layer by the fourth layer, the fifth layer comprising a tuning element disposed on the stack such that the tuning element partially overlaps with the bowtie dipole and feed structure. The sixth layer can be one-eighth a wavelength of the a desired lowest operating frequency of the antenna. The sixth layer can be made of at least one of air, polystyrene foam, glass, ceramic, porcelain, polymer, and plastic.

In another embodiment, the stack can further include a sixth layer comprising a dielectric material adjacent the first layer; and a seventh layer adjacent the sixth layer and spaced apart from the first layer by the sixth layer, the seventh layer comprising a conductive reflector element. The conductive reflector element can be made as a square or rectangular element with a minimum edge dimension of one-half a wavelength of a desired lowest operating frequency of the antenna, although other shapes are possible.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

FIG. 8, which comprises

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

The present invention is directed toward a dipole antenna and some embodiments relate to a multilayer planar high-gain antenna for ultra-wideband communications. According to various embodiments of the invention an antenna design is provided having a broadband dipole structure, a tuning plate and a feed arranged roughly parallel to one another and separated from one another with dielectric materials. In one embodiment, the antenna includes four conductive layers, a reflector, which is preferably rectangular, a broadband bowtie preferably of bowtie shape, a feed structure and a parasitic element or tuning patch.

Figure 1A:
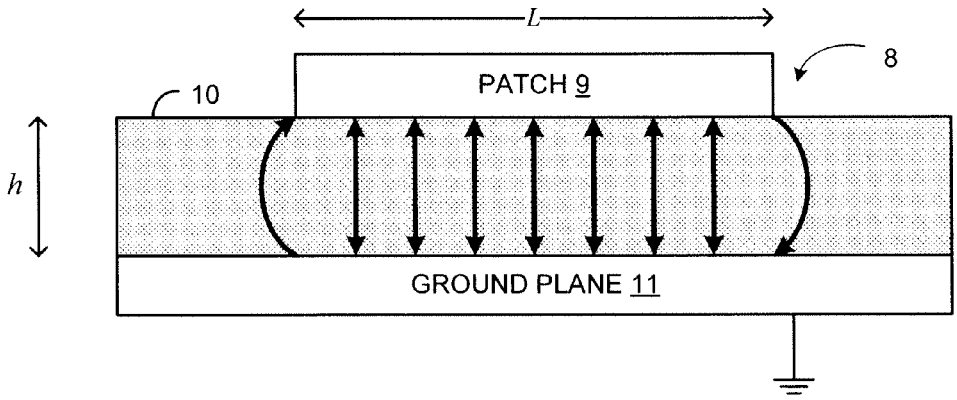
FIG. 1A is a diagram illustrating a simple example of a conventional patch antenna.
Figure 1B:
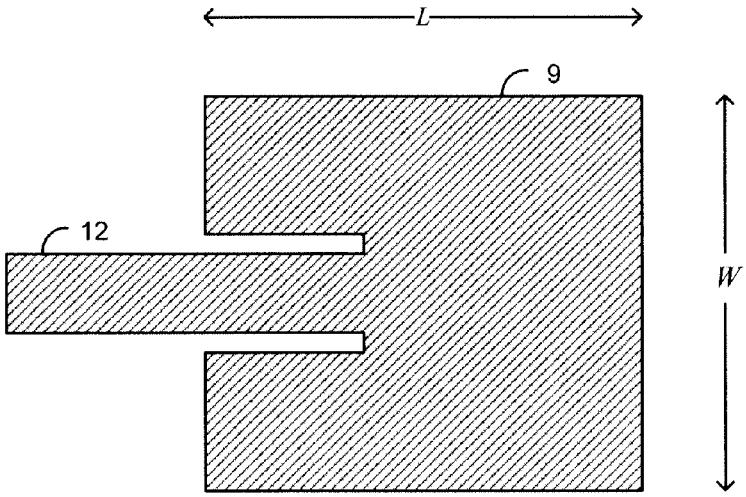
FIG. 1B is a diagram illustrating a simple example of a patch and microstrip transmission line to feed the antenna.
Figure 2:
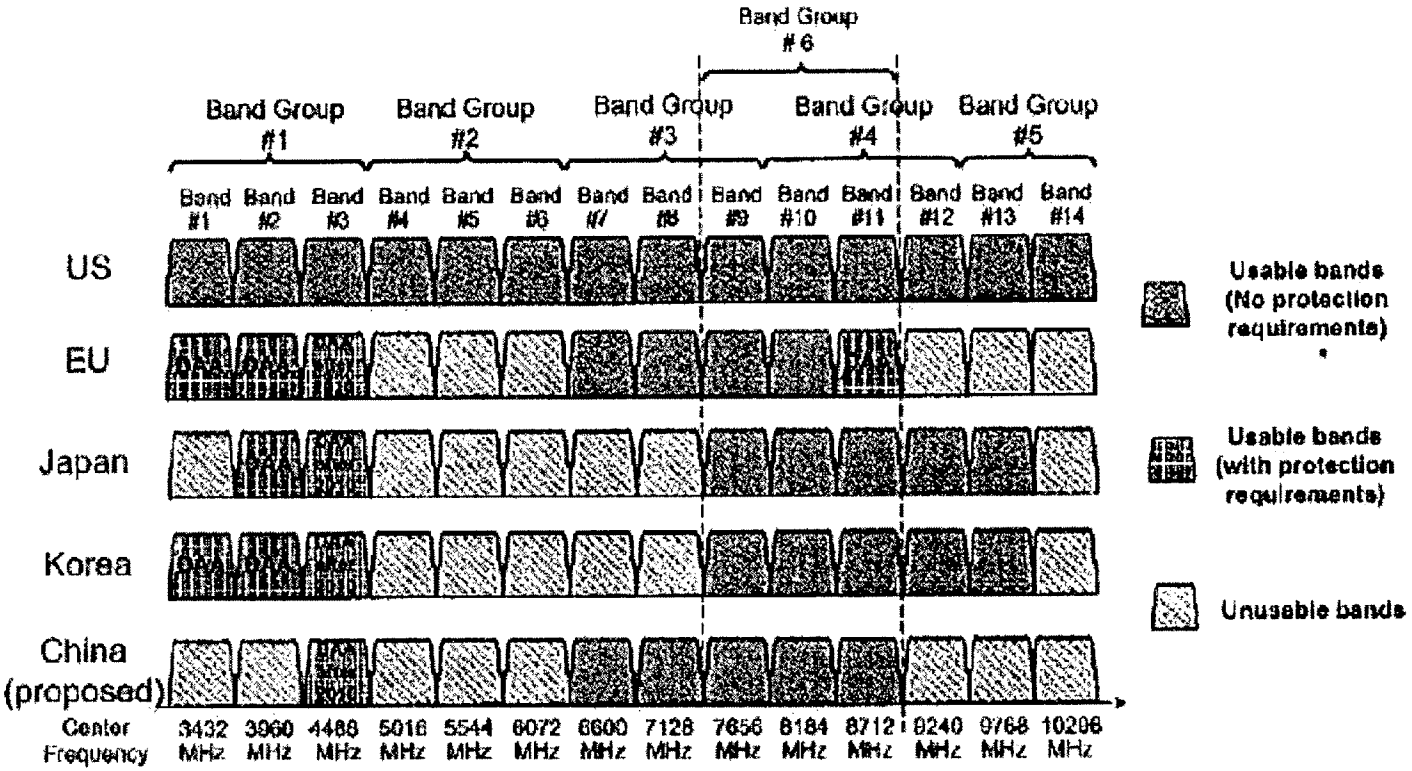
FIG. 2 is a diagram illustrating the regulatory status of band groups for UWB systems as of June 2008.
Figure 3:
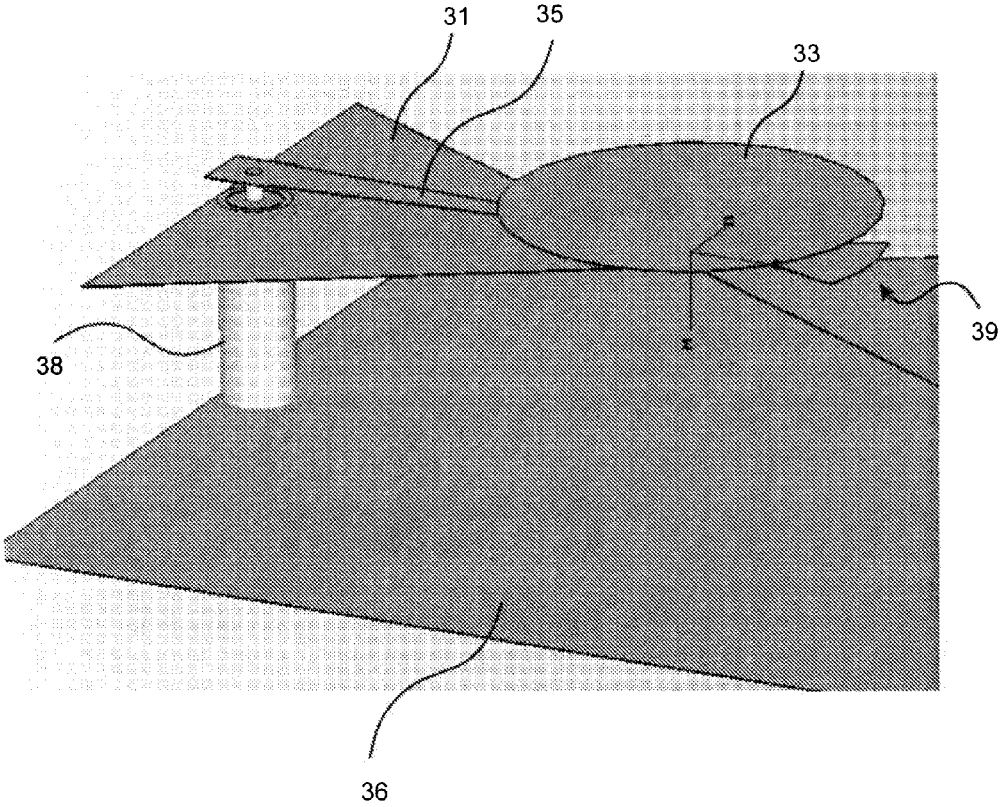
FIG. 3 is a diagram illustrating a perspective view of an example antenna in accordance with one embodiment of the invention.

FIG. 3 is a diagram illustrating a perspective view of an example antenna in accordance with one embodiment of the invention. Referring now to FIG. 3, the illustrated example includes a reflector or ground plane 36 parallel to and spaced from a wideband dipole structure 31. In the illustrated example, reflector 36 is a rectangular reflector, although other shapes and configurations are permissible.

Broadband dipole structure 31 is of a bowtie shape and configured such that one side of the bowtie structure is part of the transmission line balun, which matches one side of the dipole to the impedance of the antenna feeding coaxial cable. Disposed parallel to and above dipole 31 is an antenna feed structure that includes a transmission line balun that is terminated by the open stub 39 that serves as a coupling element to the side of the dipole is matched to the impedance of the feed.

Parasitic element, or tuning plate, 33 is a circular structure in this example and is included to serve two purposes. First, tuning plate 33 can be adjusted in dimension to optimize the voltage standing wave ratio (VSWR) of the antenna. Also, the tuning patch can be used to prevent bifurcation from the antenna at higher frequencies.

A standoff 38 can be provided to separate reflector 36 from bowtie dipole 31 as well as to separate bowtie dipole 31 from antenna feed structure 35. In one embodiment, standoff 38 can be a hollow cylindrical or other shaped structure through which the coaxial feed can be run. A standoff 38 can be useful in embodiments where the dielectric material between reflector 36 and bowtie dipole 31 is air and a support structure is needed to maintain separation between reflector 36 and bowtie dipole 31. In other embodiments where the dielectric material between reflector 36 and bowtie dipole 31 is a solid or solid-like material, standoff 38 may not be required to provide or maintain this separation, and the coaxial cable can be run directly through the dielectric. Likewise, other spacer mechanisms can be provided to maintain spacing among the conductive elements.

Figures 4, 5, 6:
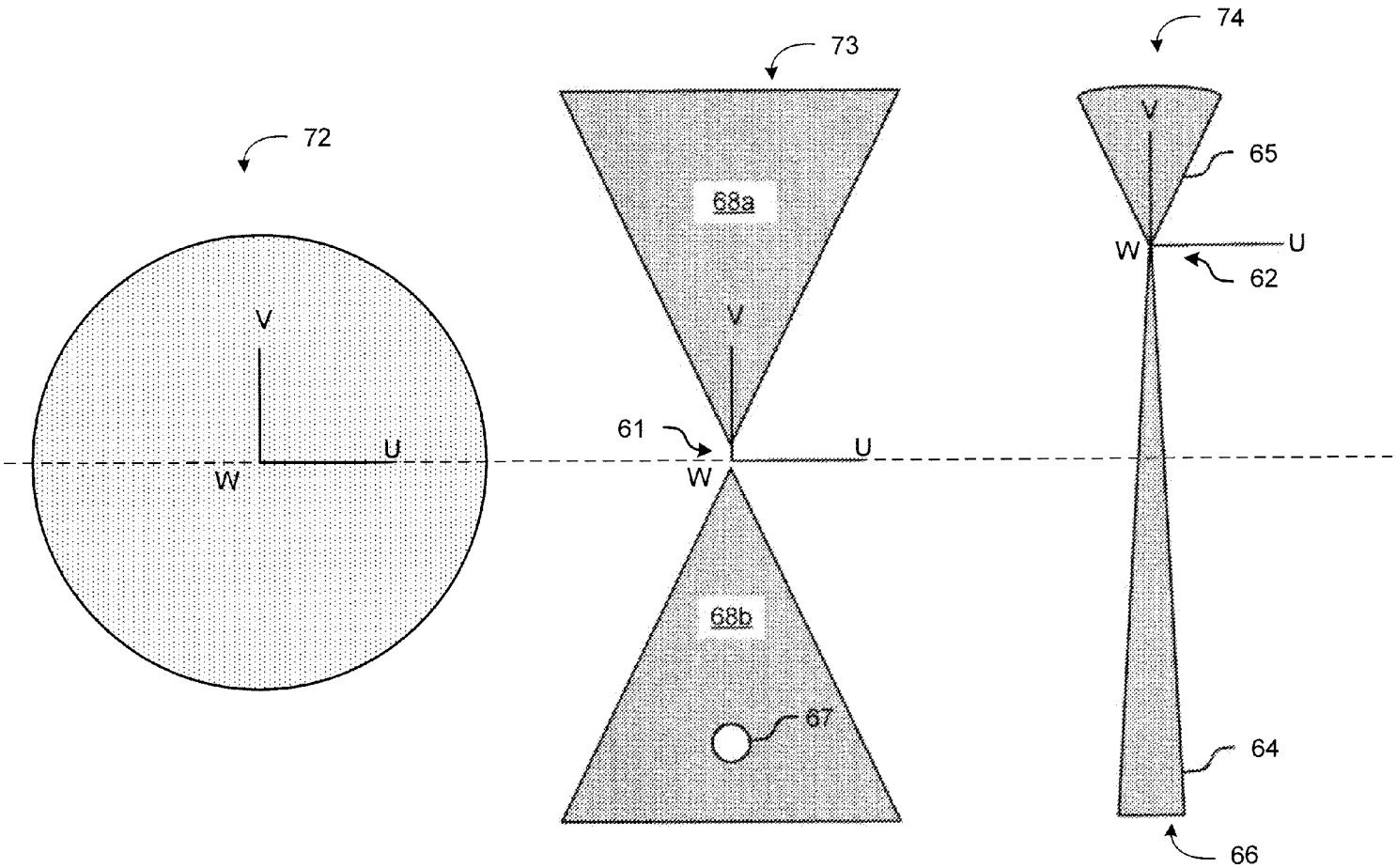
FIG. 4 is a diagram illustrating an example configuration of a tuning patch or parasitic element in accordance with the example illustrated in FIG. 3.
FIG. 5 is a diagram illustrating an example configuration for a bowtie dipole in accordance with the example illustrated in FIG. 3.
FIG. 6 is a diagram illustrating an example configuration for the antenna feed structure of the example antenna illustrated in FIG. 3.

FIG. 4 is a diagram illustrating an example configuration of a tuning patch or parasitic element 72 in accordance with the example illustrated in FIG. 3. As noted above, the parasitic element 72 can be used for impedance matching and can improve gain at low frequencies. Tuning patch 72 can be included and trimmed or sized to adjust the antenna VSWR (Voltage Standing Wave Ratio) for better matching. Because the impedance of the antenna typically is not expected to match that of the transmitter, energy transfer efficiency may suffer. The impedance of the antenna varies based on many factors including: the antenna's natural resonance at the frequency being transmitted, the antenna's separation from other objects, the size of the elements (as described above) and other factors. When an antenna and feed do not have matching impedances, some of the electrical energy in the transmit signal is not transferred to the antenna and is reflected back toward the transmitter. The interaction of these reflected waves with the waves in the signal causes standing wave patterns and can result in energy losses, distortion, and even damage to the transmitter. Accordingly, an antenna tuner, such as tuning patch 72 can be included to help match the impedance of the antenna to the transmitter. Also, because of the many and varied characteristics that affect the VS WR of an antenna, several of which are external to the antenna design itself, the dimensions of this parasitic element 72 can vary in size depending on parameters such as the size and shape of the antenna elements, the characteristic impedance of the antenna, the physical location of the antenna in its environment and other factors.

FIG. 5 is a diagram illustrating an example configuration for a bowtie dipole in accordance with the example illustrated in FIG. 3. As illustrated in this example, bowtie dipole 73 includes to conductive elements 68*a*, 68*b* shaped approximately in the form of opposed triangles. On the bottom of the broadband dipole 73 a hole or cut out 67 is provided to accommodate the shield of the coaxial feed. The shield of the feed is electrically connected to conductive element 68*b* at the cut out 67, and the center conductor continues through the hole and is electrically connected to feed structure 74.

FIG. 6 is a diagram illustrating an example configuration for the antenna feed structure 74 of the example antenna illustrated in FIG. 3. In one embodiment, feed structure 74 is capacitively coupled to bowtie dipole 73. In the illustrated example, the feed structure 74 comprises two opposed conducting structures 64, 65, which are both approximately triangular in shape. Also in this example, conducting structure 64 is elongated with respect to conducting structure 65, and has a length in the V direction greater than half the length of bowtie dipole 73. In this example, the length of conducting structure (in the V dimension) is longer than the length in the V dimension of both elements 68*a*, 68*b* of bowtie dipole 73. Feed structure 74 in this configuration is a transmission line balun that terminates in an open stub. The open stub is capacitively coupled to element 68*a*.

Figure 7:
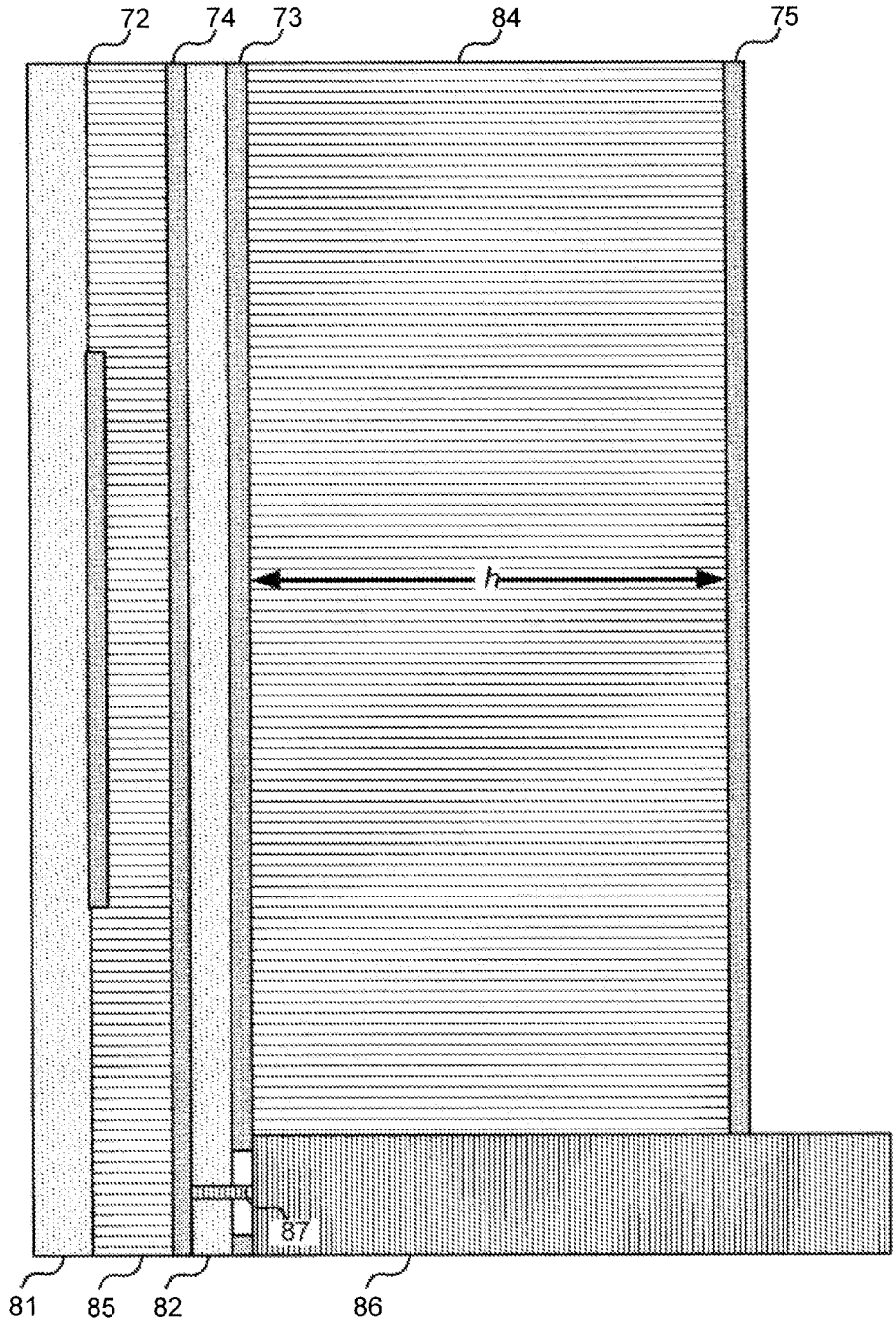
FIG. 7 is a side view of the example antenna illustrated in FIG. 3.

The dashed line across FIGS. 4, 5 and 6 crosses the centerpoints of tuning element 72 and bowtie dipole 73 and feed structure 74 with respect to the V direction. When stacked to form the antenna as shown in FIGS. 3 and 7, the center points of tuning element 72 and bowtie dipole 73 and feed structure 74 are aligned such that the center of tuning element 72 is directly above the centerpoint of feed structure 74, which is directly above the centerpoint of bowtie radiator 73. These elements are centered in the U direction as well, and are aligned in the orientation illustrated in FIGS. 4, 5 and 6. It is noted, however, that the centerpoint at which these structures are aligned is the point of rotational symmetry for tuning patch 72 and bowtie dipole 73. This centerpoint for dipole bowtie 73 is the center of the area at which the two dipole elements meet. Note that for true dipole operation, elements 68*a*, 68*b* of bowtie dipole 73 do not physically meet or overlap, but are separated from one another by a distance sufficient to achieve desired dipole operation. As would be known to one of ordinary skill in the art, this distance can be determined and will vary based on the operating frequency of the antenna and the permittivity of the dielectric between the elements 68*a*, 68*b*.

For feed structure 74, the intersection area 62 at which two opposed conducting structures 64, 65 meet is offset from the center of the bowtie dipole 73. As illustrated in FIGS. 5 and 6, this point 62 overlaps with an area closer to the center of the upper dipole element 68*a*. Area 62 on feed structure is a high impedance area, and the length (along the V axis) of element 64 is chosen such that the impedance at the feed end is low impedance. Preferably, the length of element 64 along the V axis is chosen such that the impedance is 50Ω at the feed point, although other lengths and input impedances can be used. Accordingly, the feed structure 74 matches the upper side of dipole 73 to the transmitter coax.

FIG. 7 is a side view of the example antenna illustrated in FIG. 3. Referring now to FIGS. 3 and 7, the antenna of this example includes a bowtie dipole 73 patterned on one side of a double sided printed circuit board (PCB) 82 and feed structure 74 patterned on the other side of printed circuit board 82. Additionally, the tuning element 72 is patterned on one side of a single sided printed circuit board 81.

The printed circuit board structure with tuning element 72 is separated from the double sided printed circuit board 82 with its associated patterned element 73, 74 by a dielectric material 85. Preferably, this stack is configured such that tuning element 72 is at least roughly parallel to feed structure 74, which is at least roughly parallel to bowtie dipole 73.

These are at least approximately parallel to ground plane 75, and separated from ground plane 75 by a dielectric material 84 such that element 73 is separated from reflector 75 by a distance h. In one embodiment, distance, h, is one-eighth a wavelength of the desired lowest operating frequency (218), although other separation distances are permitted. For example, for an antenna operating at 3 GHz, the spacing is 12.5 mm.

Because the reflector 75 in one embodiment occupies a larger area than the structures 72, 73, 74, the reflector 75 determines the antenna size. The reflector 75 can be configured in a number of different shapes but, in one embodiment, is generally rectangular, squared or circular. In one embodiment, the reflector 75 is a minimum size of λ/2 (one-half wavelength of the desired lowest operating frequency), although other dimensions can be used. For the example given above for an antenna operating at 3 GHZ, a square reflector 51 is, in one embodiment, at least approximately 50×50 mm.

Dielectric materials are typically air or polystyrene foam, but other dielectric materials can be used, including glasses, ceramics, porcelains, polymers, plastics, and other materials. The conductive elements for radiator 73 and feed 74 and tuning element 72 can be made by depositing an electrically conductive material onto their respective substrates by known techniques. These techniques can include, for example, etching or photo etching conductive traces in the desired forms onto a thin flexible, semi-rigid or rigid substrate, such as a circuit board. The printed circuit board material can be any of a number of materials, including dielectrics to provide electrical isolation between the various elements that they separate. Different materials can provide different insulating values and some can include polytetrafluoroethylene (Teflon), liquid crystal polymers, phenolics, phenolic cotton paper, cotton paper and epoxy, woven glass and epoxy, matte glass and polyester, woven glass and polyester, and any of a number of other PCB materials. In one embodiment, the substrate is made using Rogers RO3000® family of ceramic-filled PTFE composite High Frequency Circuit Materials such as, for example, Rogers RO3003™.

The printed circuit boards 81, 82 can be bonded to their adjacent dielectric spacers 84, 85 and the reflector 75 bonded to the other side of the dielectric spacer 84 to create the package shown in FIG. 7. Other fabrication techniques and orders of assembly can be used to assemble the package shown in FIGS. 3 and 7.

The conductive elements for radiator 73, reflector 75, feed 74 and tuning element 72 can include materials such as copper, silver, and gold as well as conductive alloys, conductive polymers, conductive carbon films, and the like. In some embodiments, these elements are flexible so that the antenna can be shaped to conform to the form factor of the device with which it is implemented.

Coaxial cable 86 is included to connect the antenna to the transmitter/receiver. Center conductor 87 passes through hole 67 (FIG. 5) of dipole 73 and is electrically connected to feed element 64. Conductor 87 can be soldered or otherwise connected to feed element 64. The outer ring or shield (not shown) of coaxial cable 88 is soldered or otherwise electrically connected to dipole element 68*b*.

Figure 8A:
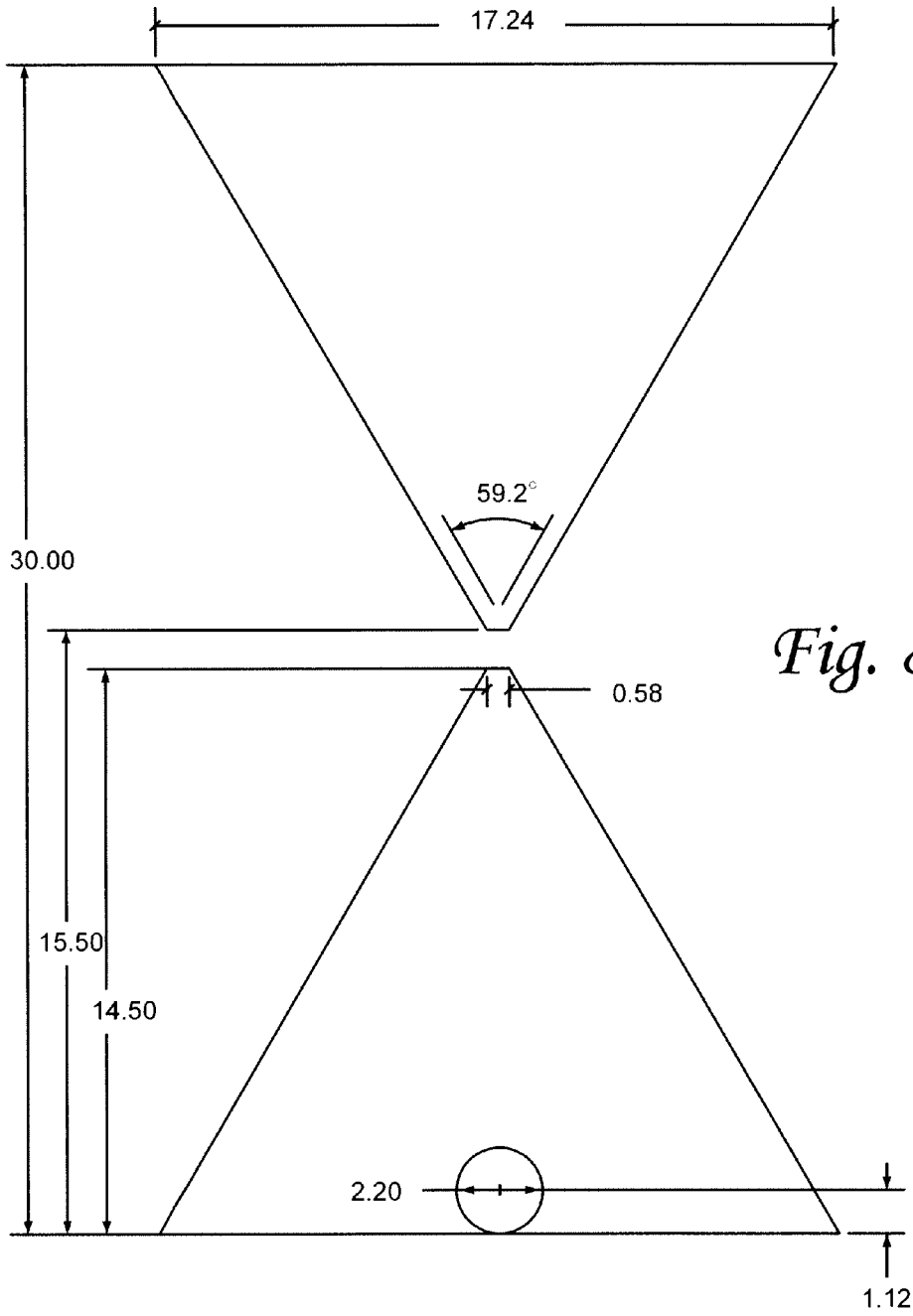
FIGS. 8A-8E, illustrates example dimensions for an example antenna in accordance with one embodiment of the invention.
Figure 8B:
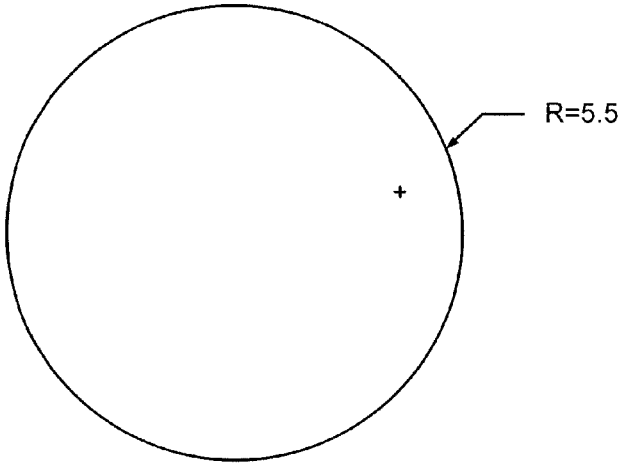
Figure 8C:
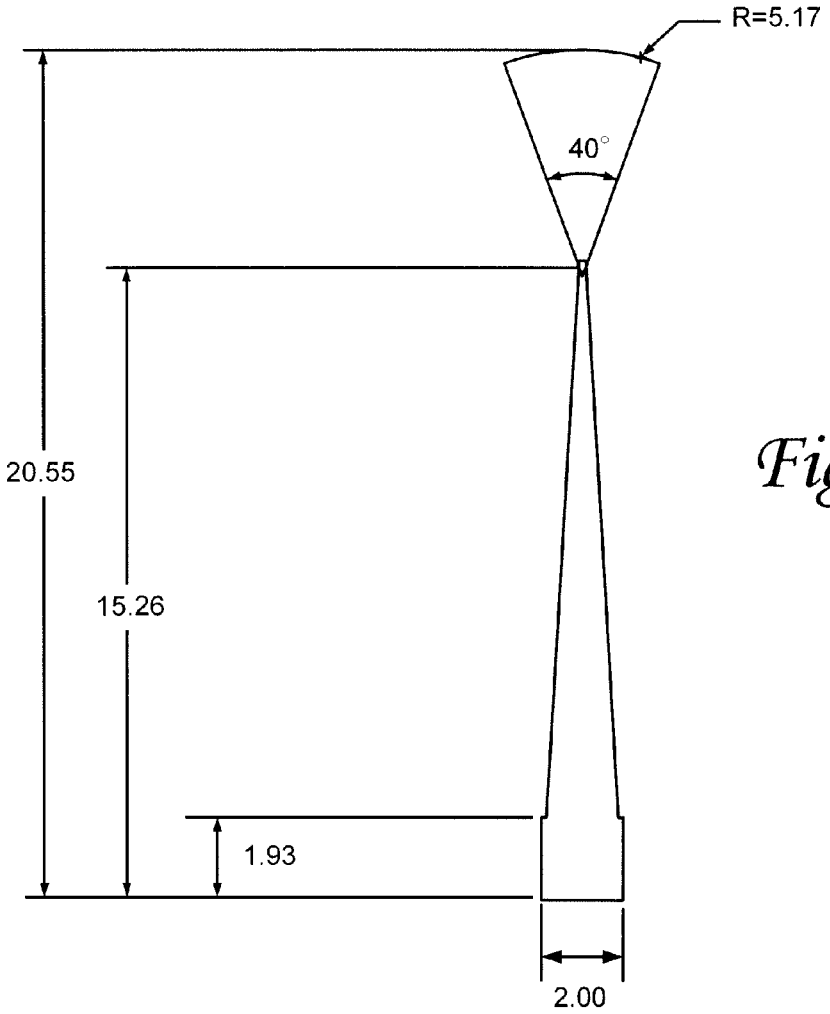
Figure 8D:
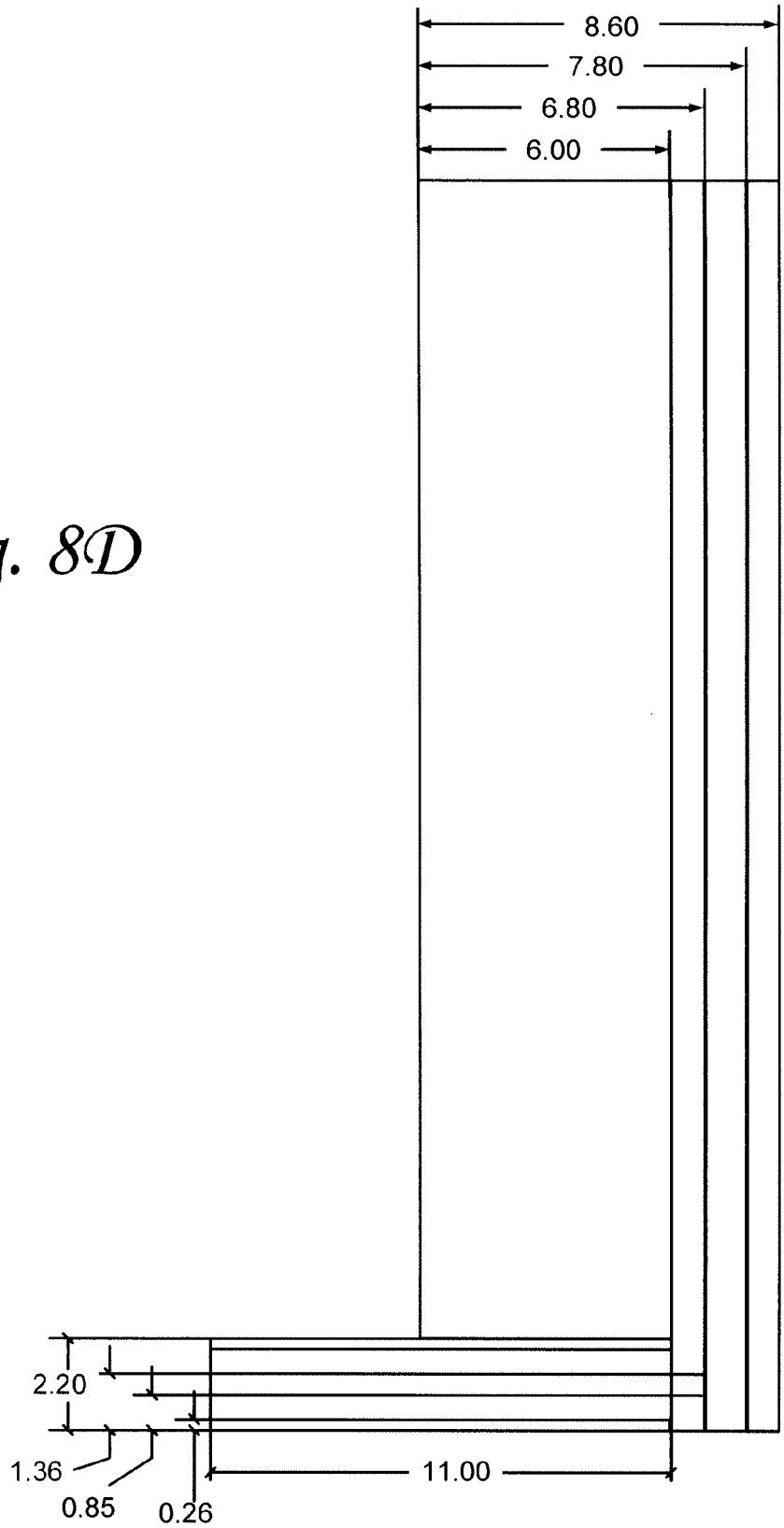
Figure 8E:
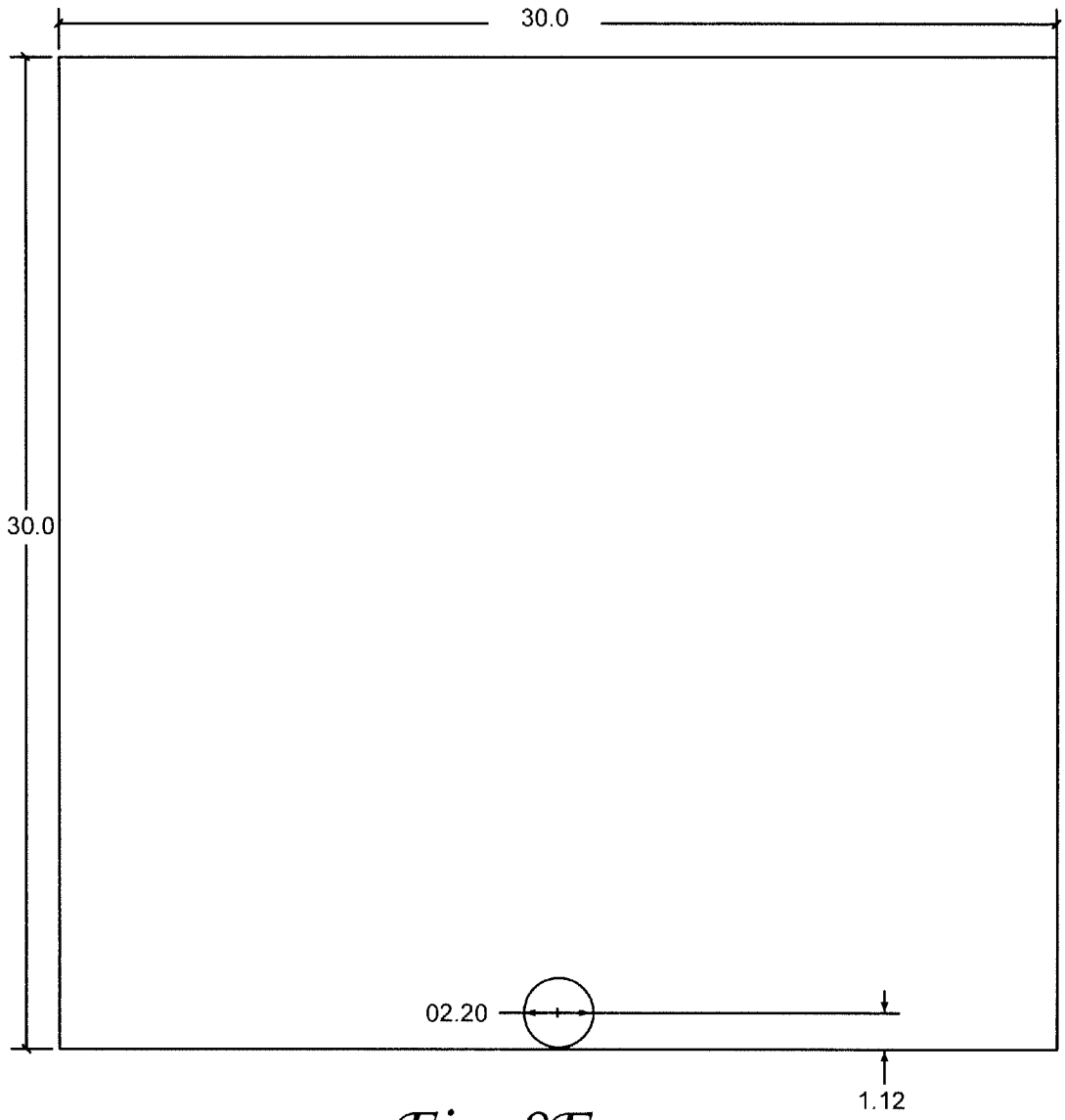

FIG. 8, which comprises FIGS. 8A-8E, illustrates example dimensions for an example antenna in accordance with one embodiment of the invention. The dimensions shown in FIG. 8 are in millimeters and are suitable for an antenna operating in a frequency range of 6-9 GHz. Particularly, FIG. 8A shows an example of the bowtie dipole 73; FIG. 8B illustrates an example radius for tuning element 72; FIG. 8C illustrates example dimensions for feed structure 74; FIG. 8D illustrates example thicknesses for the layers as shown in FIG. 7; and FIG. 8E illustrates example dimensions for a reflector 75.

Figure 9:
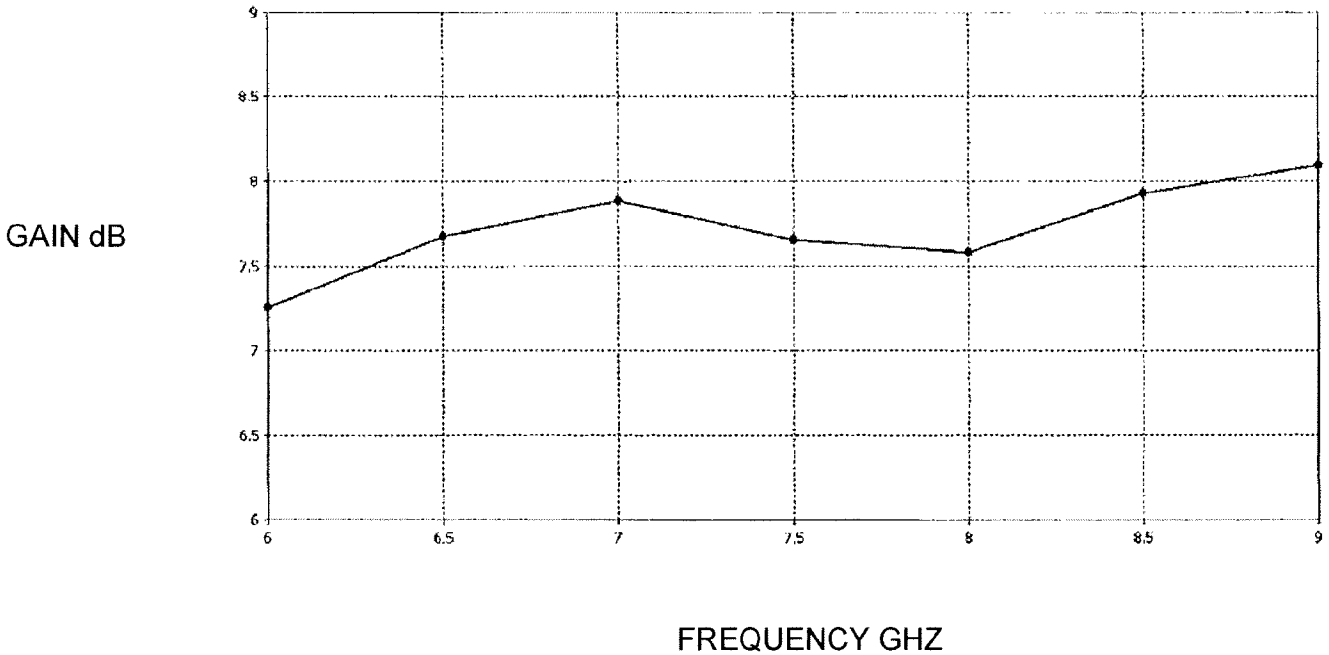
FIG. 9 is a diagram illustrating gain vs. frequency for the example illustrated and described with reference to FIG. 8.
Figure 10:
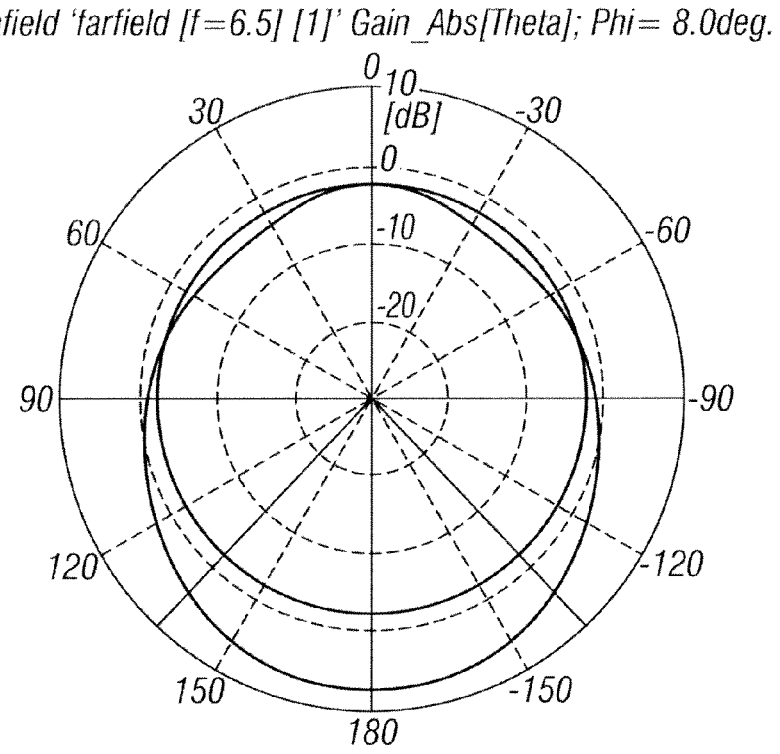
FIG. 10 illustrates the Antenna Farfield Radiation Pattern (azimuth) for the example antenna at a frequency of 6.5 GHz.
Figure 11:
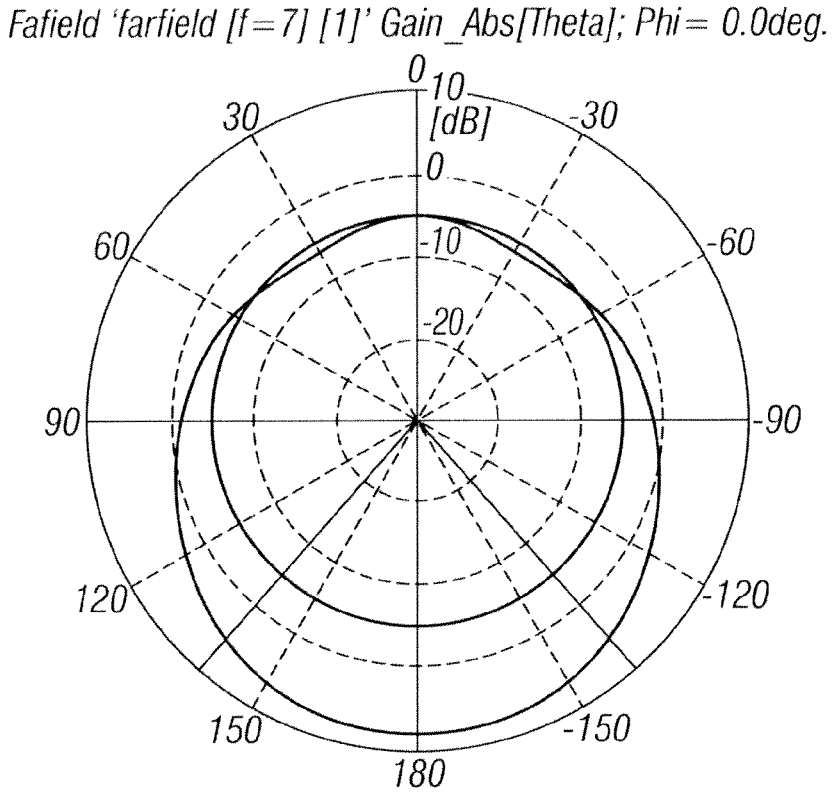
FIG. 11 illustrates the Antenna Farfield Radiation Pattern (azimuth) for the example antenna at a frequency of 7 GHZ.
Figure 12:
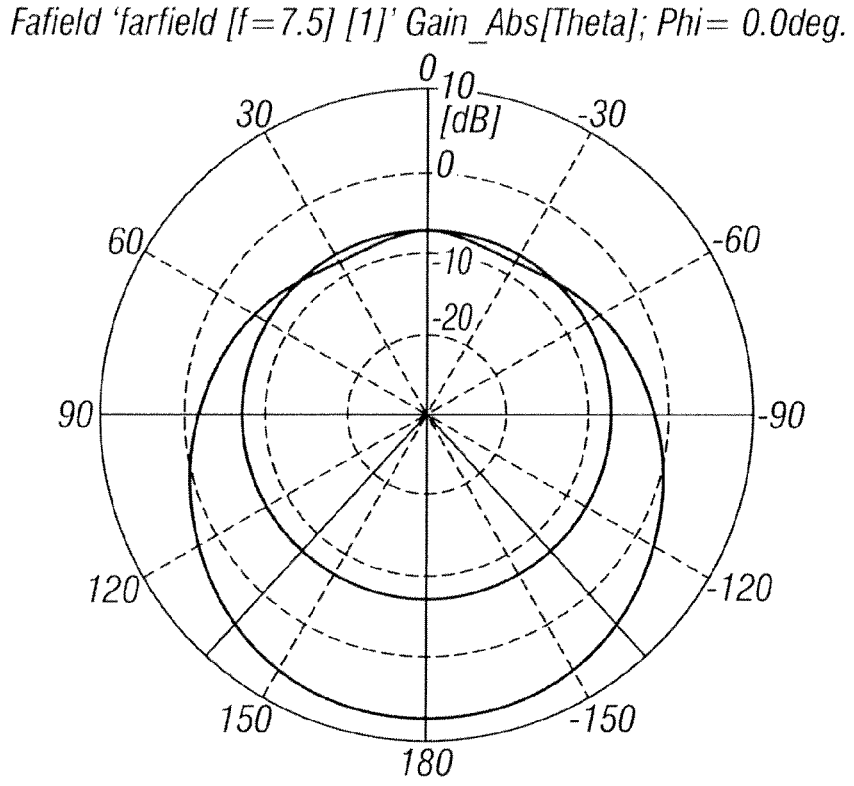
FIG. 12 illustrates the Antenna Farfield Radiation Pattern (azimuth) for the example antenna at a frequency of 7.5 GHZ.
Figure 13:
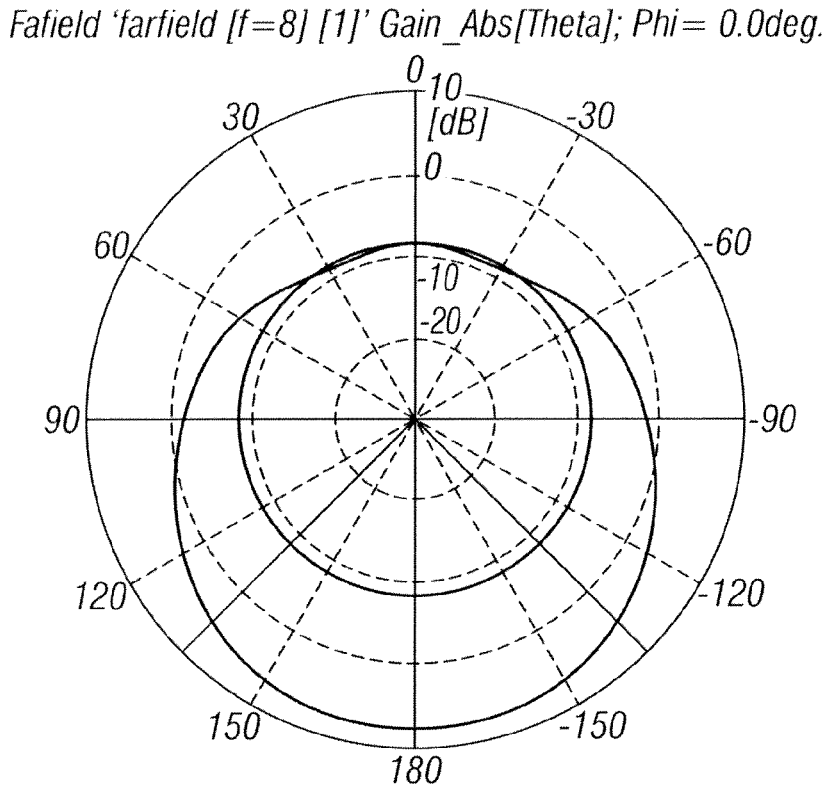
FIG. 13 illustrates the Antenna Farfield Radiation Pattern (azimuth) for the example antenna at a frequency of 8 GHZ.
Figure 14:
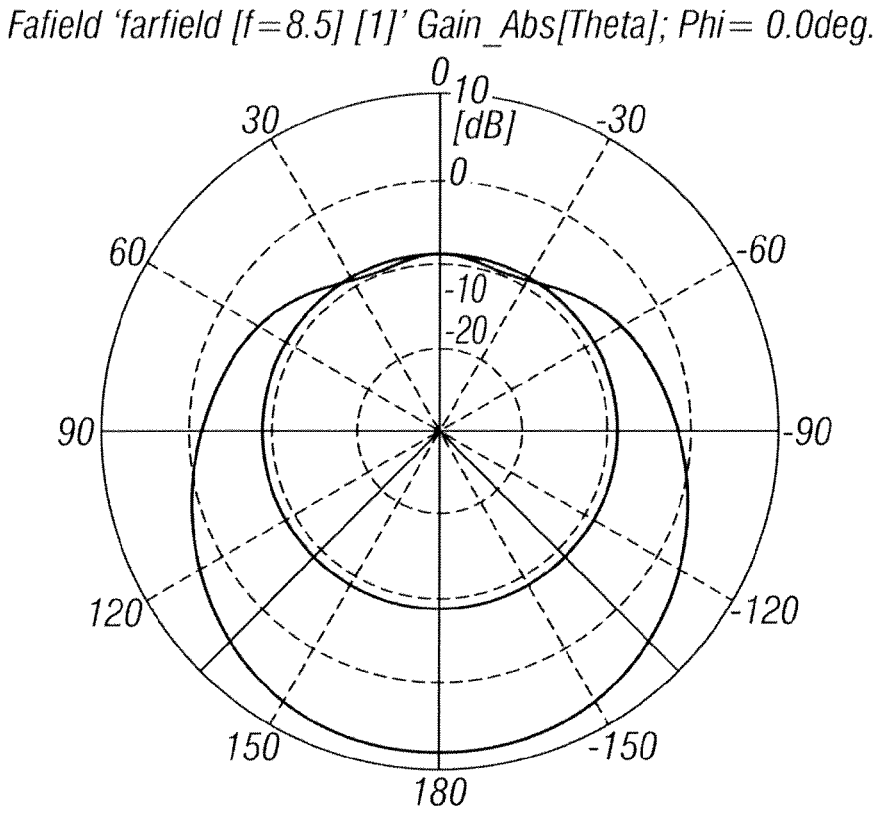
FIG. 14 illustrates the Antenna Farfield Radiation Pattern (azimuth) for the example antenna at a frequency of 8.5 GHZ.

FIG. 9 is a diagram illustrating gain vs. frequency for the example illustrated and described above with dimensions as set forth in FIG. 8. The gain in this example exhibits a total variation of less than 1 dB in full frequency range from 6-9 GHz. Average gain of this antenna is around 7.7 dB. Farfield Radiation patterns for this example antenna for various frequencies are shown on the FIGS. 9-13. According to these figures, the approximate 3 dB beam width is 90 degrees across the band of interest. FIG. 10 illustrates the Antenna Farfield Radiation Pattern (azimuth) for the example antenna at a frequency of 6.5 GHz. FIG. 11 illustrates the Antenna Farfield Radiation Pattern (azimuth) for the example antenna at a frequency of 7 GHZ. FIG. 12 illustrates the Antenna Farfield Radiation Pattern (azimuth) for the example antenna at a frequency of 7.5 GHZ. FIG. 13 illustrates the Antenna Farfield Radiation Pattern (azimuth) for the example antenna at a frequency of 8 GHZ. FIG. 14 illustrates the Antenna Farfield Radiation Pattern (azimuth) for the example antenna at a frequency of 8.5 GHZ.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. An antenna, comprising:

a bowtie dipole disposed on a first side of a substrate, the bowtie dipole comprising first and second opposed conductive elements, wherein each of the first and second opposed elements of the bowtie dipole is defined by a triangular pattern; and a feed structure disposed on a second side of the substrate, the feed structure comprising first and second opposed feed elements having a length, width and height, wherein the width of the first feed element is tapered from a first width at a first end of the first feed element to a second width at a second end of the first feed element, the width of the second feed element is tapered from a third width at a first end of the second feed element to a fourth width at the second end of the second feed element and wherein the first and second opposed feed elements are coplanar and have an intersection area at their respective first ends, and further wherein the length of the second feed element is longer than a length of each of the first and second opposed elements of the bowtie dipole, and wherein the feed structure is disposed on the substrate such that the first element of the feed structure overlaps with the first element of the bowtie dipole and the second feed element overlaps with both the first and second elements of the bowtie dipole, the second feed element being directly electrically connected to a center conductor of a transmission line;

wherein the length of the second feed element is chosen so as to impedance match the first element of the bowtie dipole with the transmission line for feeding the antenna.

2. The antenna of claim 1, further comprising a tuning element substantially parallel to and spaced from the bowtie dipole and the feed structure by a dielectric material.

3. The antenna of claim 2, wherein the tuning element is positioned such that a center of the tuning element is aligned with a center of the bowtie dipole.

4. The antenna of claim 2, wherein the tuning element is circular.

5. The antenna of claim 1, further comprising a reflector substantially parallel to and spaced apart from the bowtie dipole with a dielectric material between the reflector and the bowtie dipole.

6. The antenna of claim 1, further comprising a reflector substantially parallel to the bowtie dipole, wherein the reflector, bowtie dipole and feed structure are configured in a multilayer stack of conductive elements separated by dielectric material.

7. The antenna of claim 1, wherein conducting elements of the antenna comprise at least one of copper, gold, silver, conductive alloys, conductive polymers, and conductive carbon films.

8. The antenna of claim 1, wherein the substrate comprises at least one of polytetrafluoroethylene, liquid crystal polymers, phenolics, phenolic cotton paper, cotton paper and epoxy, woven glass and epoxy, matte glass and polyester, woven glass and polyester.

9. A multilayer antenna stack, comprising:

a first layer comprising a bowtie dipole comprising a pair of first and second opposed conductive elements, wherein each of the first and second opposed elements of the bowtie dipole is defined by a triangular pattern;

a second layer comprising a dielectric material adjacent the first layer; and a third layer adjacent the second layer and spaced apart from the first layer by the second layer, the third layer comprising a feed structure, the feed structure comprising a pair of first and second opposed feed elements having a length, width and height, wherein the width of the first feed element is tapered from a first width at a first end of the first feed element to a second width at a second end of the first feed element, the width of the second feed element is tapered from a third width at a first end of the second feed element to a fourth width at the second end of the second feed element and wherein the first and second opposed feed elements are coplanar and have an intersection area at their respective first ends, and further, wherein the length of the second feed element is longer than a length of each of the first and second opposed elements of the bowtie dipole, and wherein the feed structure is disposed on the second layer such that the first element of the feed structure overlaps with the first element of the bowtie dipole and the second feed element overlaps with both the first and second elements of the bowtie dipole, the fourth element being directly electrically connected to a center conductor of a transmission line;

wherein the length of the second feed element is chosen so as to impedance match the first element of the bowtie dipole with the transmission line for feeding the antenna.

10. The multilayer antenna of claim 9, further comprising a fourth layer comprising a dielectric material adjacent the third layer and a fifth layer adjacent the fourth layer and spaced apart from the third layer by the fourth layer, the fifth layer comprising a tuning element disposed on the stack such that the tuning element partially overlaps with the bowtie dipole and feed structure.

11. The multilayer antenna of claim 10, wherein the tuning element is circular.

12. The multilayer antenna of claim 9, further comprising:

a sixth layer comprising a dielectric material adjacent the first layer; and a seventh layer adjacent the sixth layer and spaced apart from the first layer by the sixth layer, the seventh layer comprising a conductive reflector element.

13. The multilayer antenna of claim 12 wherein the conductive reflector element is square or rectangular with a minimum edge dimension of one-half a wavelength of a desired lowest operating frequency of the antenna.

14. The multilayer antenna of claim 12 wherein the sixth layer is one-eighth a wavelength of a desired lowest operating frequency of the antenna.

15. The multilayer antenna of claim 9, wherein conducting elements of the antenna comprise at least one of copper, gold, silver, conductive alloys, conductive polymers, and conductive carbon films.

16. The multilayer antenna of claim 9, wherein the second layer comprises at least one of polytetrafluoroethylene, liquid crystal polymers, phenolics, phenolic cotton paper, cotton paper and epoxy, woven glass and epoxy, matte glass and polyester, woven glass and polyester.

17. The multilayer antenna of claim 12, wherein the sixth layer comprises at least one of air, polystyrene foam, glass, ceramic, porcelain, polymer, and plastic.

18. The antenna of claim 1, wherein the first feed element and the second feed element are substantially triangular in shape.

19. The multilayer antenna of claim 9, wherein the first feed element and the second feed element are substantially triangular in shape.

20. An antenna, comprising:

dipole means disposed on a first side of a substrate, the dipole means comprising a pair of first and second opposed conductive elements, wherein each of the first and second opposed elements of the dipole means is defined by a triangular pattern; and feed means disposed on a second side of the substrate, the feed means comprising a pair of first and second opposed feed elements having a length, width and height, wherein the width of the first feed element is tapered from a first width at a first end of the first feed element to a second width at a second end of the first feed element, the width of the second feed element is tapered from a third width at a first end of the second feed element to a fourth width at the second end of the second feed element and wherein the first and second opposed feed elements are coplanar and have an intersection area at their respective first ends, and further, wherein the length of the second feed element is longer than a length of each of the first and second opposed elements of the dipole means, and wherein the feed means is disposed on the substrate such that the first element of the feed means overlaps with the first element of the dipole means and the second feed element overlaps with both the first and second elements of the dipole means, the second feed element being directly electrically connected to a center conductor of a transmission line;

wherein the length of the fourth element is chosen so as to impedance match the first element of the dipole means with the transmission line for feeding the antenna.

* * * * *

UNITED STATES PATENT AND TRADEMARK OFFICE

CERTIFICATE OF CORRECTION

PATENT NO. : 8,717,245 B1
APPLICATION NO. : 12/725383
DATED : May 6, 2014
INVENTOR(S) : Krivokapic et al.

It is certified that error appears in the above-identified patent and that said Letters Patent is hereby corrected as shown below:

In the Specification

Column 8, line 2, "frequency 218" should read --frequency ($\lambda/8$)--

Signed and Sealed this
Fifteenth Day of July, 2014

Michelle K. Lee

Michelle K. Lee
*Deputy Director of the United States Patent and Trademark Office*